United States Patent [19]

Pakradooni

[11] 4,114,867

[45] Sep. 19, 1978

[54] COIL SPRING ASSEMBLY

[75] Inventor: Hamlin Andrus Pakradooni, Webster, Mass.

[73] Assignee: Webster Spring Co. Inc., Oxford, Mass.

[21] Appl. No.: 862,725

[22] Filed: Dec. 21, 1977

Related U.S. Application Data

[63] Continuation of Ser. No. 725,037, Sep. 20, 1976, abandoned.

[51] Int. Cl.[2] ..... F16F 3/04

[52] U.S. Cl. ..... 267/97; 5/260

[58] Field of Search ..... 267/80, 91, 96, 97, 267/102; 5/246, 256, 260

[56] References Cited

U.S. PATENT DOCUMENTS 3,479,672 11/1969 Haney et al. ..... 267/97

FOREIGN PATENT DOCUMENTS 537,800 3/1957 Canada ..... 267/102

823,532 11/1959 United Kingdom ..... 267/97

*Primary Examiner*—George E. A. Halvosa

*Attorney, Agent, or Firm*—Dike, Bronstein, Roberts, Cushman & Pfund

[57] ABSTRACT

A spring assembly embodying along the front edge a row of coil springs, each of which has end loops and intermediate the end loops a series of turns which diminish in diameter from the top to the bottom, the loop at the top being inclined to the axis of the coils and providing in conjunction with an upwardly bent portion of the border wire at the top of the assembly a supporting barrier at the front edge of the assembly such as to retain a cushion in place under conditions tending to slide the cushion forwardly.

1 Claim, 6 Drawing Figures

COIL SPRING ASSEMBLY

This is a continuation of application Ser. No. 725,037, filed Sept. 20, 1976 now abandoned.

BACKGROUND OF THE INVENTION

Coil spring assemblies for furniture such as chairs and sofas take various forms, some being made of a plurality of coil springs, others in the form of spring straps, and still others a combination of coils and straps. A problem common to all such spring assemblies is to provide a comfortable front edge and also a structure in which the front edge will remain attractive throughout use and in particular an edge which will restrain forward slipping movement of the cushion. Various treatments are resorted to and one commonly employed which did not require modification of the spring assembly itself was to apply a rolled edge to the forward edge of the spring assembly. Other treatments are disclosed in the Haney U.S. Pat. Nos. 3,479,672 and 3,324,485, Riddle 3,908,974, Bond 3,356,358 and Isaacs 3,117,774. Except for the Haney patent, the structures disclosed are not applicable to a coil spring assembly. The structure disclosed in the Haney patents is not entirely satisfactory because the sharp angle of inclination of the top loops of the coils tends to distort the cushion when no one is seated and provides inadequate support when someone is seated. The structure disclosed in this application is designed to overcome the disadvantages of the structures shown in the aforesaid patents and, in particular, to provide a structure which is particularly applicable to coil spring assemblies.

SUMMARY OF THE INVENTION

As herein illustrated, the invention resides in an upholstery spring assembly comprising a plurality of coil springs secured at their upper and lower ends to top and bottom frame members wherein the springs along the front edge of the assembly each comprise a continuous helical coil having end loops and intermediate the end loops a series of turns which diminish in diameter from the top to the bottom and wherein the top loop of each coil is inclined to the axis of the coil so as to slope upwardly from the back side of the coil and has a first portion which slopes upwardly and forwardly from the back side at a relatively flat angle to approximately the axis of the coil and a second portion which slopes upwardly and forwardly from the first portion at a relatively sharp angle to the axis of the coil so as to provide a relatively flexible low angle support rearwardly of the axis and a relatively rigid high angle support forwardly of the axis. The upper frame member is correspondingly bent upwardly at substantially the break between the first and second portions of the upper loops of the coils at an angle corresponding to the inclination of the upwardly bent second portions of the coils and there are fastening devices for fastening the distal ends of the second portions of the loops to the front edge of the frame member, and fastening means securing the sides of the upwardly bent second portions of the coils at the opposite ends of the front row to the upwardly inclined side edges of the frame member.

The invention will now be described with reference to the accompanying drawings wherein.

Figure 1:
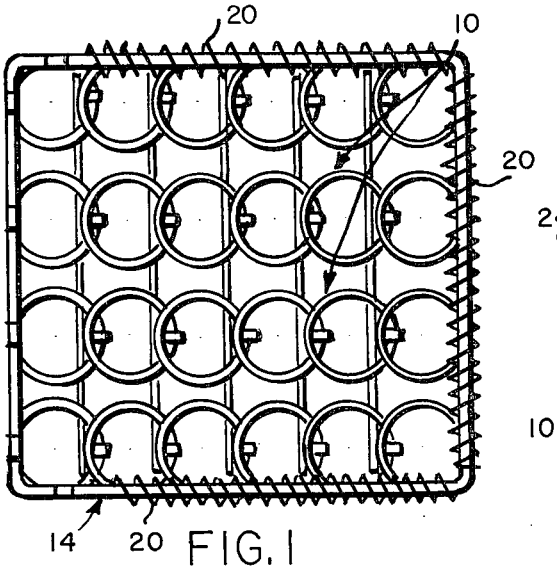
FIG. 1 is a plan view of the top of the frame assembly.

Referring to the drawings, FIG. 1, the assembly comprises a plurality of helical coil springs 10 arranged in spaced, parallel, longitudinally and transversely extendings rows supported at their lower ends by a frame member 12 and supported at their upper ends by a frame member 14.

Figure 5:
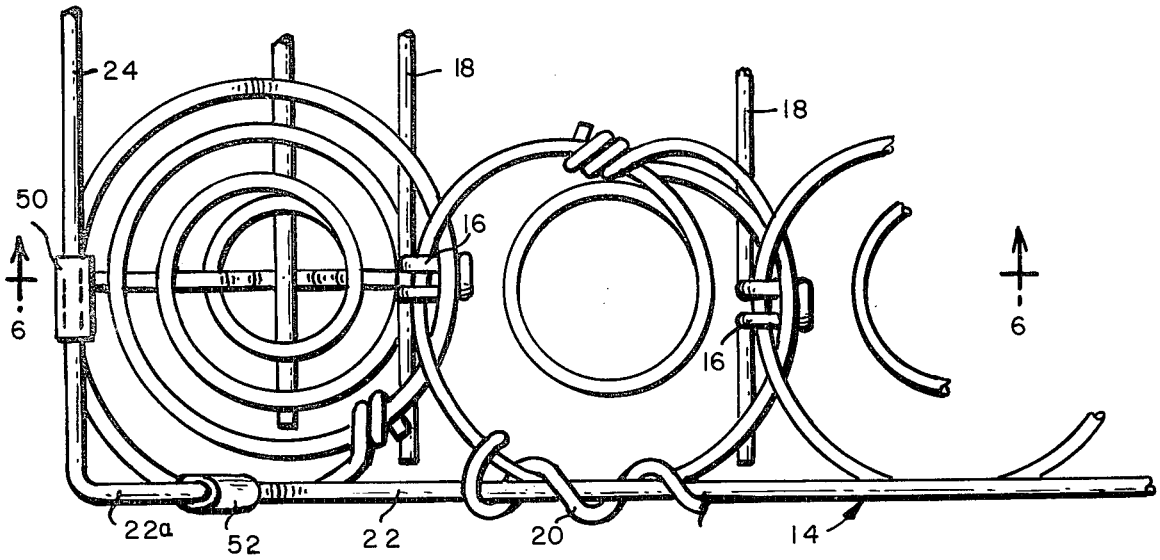
FIG. 5 is a fragmentary plan view looking down at the top of FIG. 4.
Figure 6:
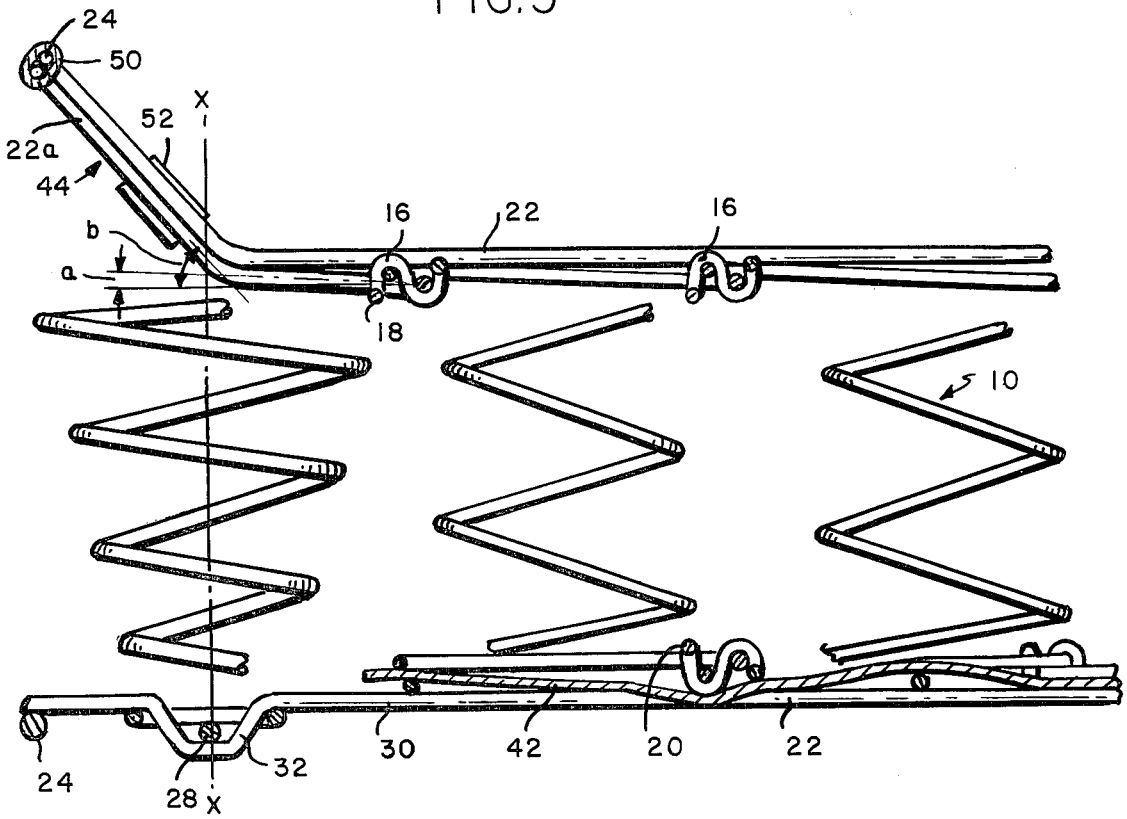
FIG. 6 is a fragmentary view taken on the line 6—6 of FIG. 5.

The top loops of the coils in the rows of coils extending from front to back overlap while the top loops of the coils in the rows transversely are spaced from each other. The overlapping portions of the top loops in the rows of coils extending from front to back are flexibly connected to each other by crimps 16, FIGS. 5 and 6, formed in transversely extending wires 18 which thus not only connect the overlapping portions of the top loops of the coils to each other, but connect the coils in adjacent rows to each other. As shown in FIG. 6, the wires 16 are bent upwardly and over the forwardly projecting top loops of the second row of coils and downwardly between the overlapping loops and upwardly about the rearwardly projecting loops of the first row of coils. The ends of the wires 18 are unattached to the side of the top frame member. The border coils, except for the front row of the coils, are attached to the sides of the frame member by spiral coils 20.

The lower ends of the coils, except for the front row of coils, are attached to each other both longitudinally and transversely of the frame in the same manner as the upper ends of the coils are attached to each other by means of transversely extending wires 20, FIG. 6, crimped at the overlapping portions of the lower ends of the coils.

Figure 2:
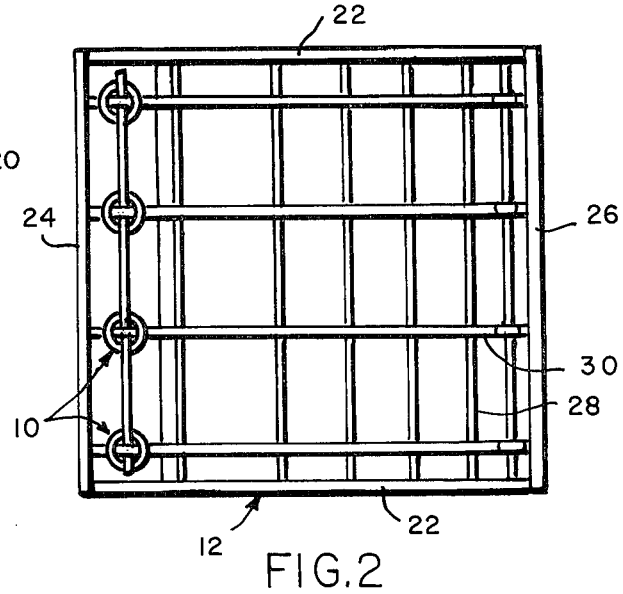
FIG. 2 is a plan view of the bottom of the frame assembly.

The lower frame member 12 is of rectangular configuration and is comprised, as shown in FIG. 2, of relatively large gauge wire, including spaced parallel side members 22—22 and spaced parallel front and rear members 24 and 26 welded at their intersections to each other. In addition, there are transversely and longitudinally extending stiffening members 28 and 30. The stiffening members 30 are spaced longitudinally of the frame and welded at their front and rear ends to the front and rear wires 24 and 26. Each member 30 contains adjacent its forward end a downwardly depressed portion forming at the lower side of the lower frame member a truncated protrusion 32. The transverse wires 28 are longitudinally spaced and, except for the wire at the front and the wire at the rear, are welded to the side wires 22—22. All of the crossing wires 28—30 are welded to each other at their crossings.

The lower frame member 12 forms a rigid support at the lower ends of the coils and certain of the lower ends of the coils are rigidly attached thereto and others rest on but are unattached so as to provide for a certain amount of lateral movement, particularly within the area inwardly of the border coils. Specifically, the lower ends of the coils of the front row are nonrotatably locked to the lower frame member by the lowermost turns of the coils which pass below the longitudinally extending wires 30 about the protrusion 32 and above the transversely extending wires 28. The first transverse line of coils rearwardly of the front row of coils and the border coils at opposite sides and along the rear are attached to the frame member by wire clips 40. The coils intermediate the border coils and the back line of coils are unattached to the frame and so provide for some lateral shifting of the coils. In addition, the lower unattached ends of the coils provide a space for introducing a sheet of flexible material 42 in the form of paper or fabric which reduces the accumulation of dust and dirt within the spring structure and by minimizing metal-to-metal contact of the springs with the supporting frame, reduces noise caused by rubbing of the parts against each other.

The front row of coils are conical and arranged with the loop of larger diameter at the top, the remaining coils are hourglass-shaped having loops of the same size at the top and bottom. The front and back row of coils are relatively heavy gauge wire and those intermediate the front and back of relatively light gauge wire.

The foregoing structure is generally of standard construction substantially similar in construction to that shown in U.S. Pat. No. 2,910,114, to which reference may be had for specific details as to mounting the structure within the framework of a chair or divan. Assemblies thus described are generally referred to as "drop in spring platforms".

Figure 3:
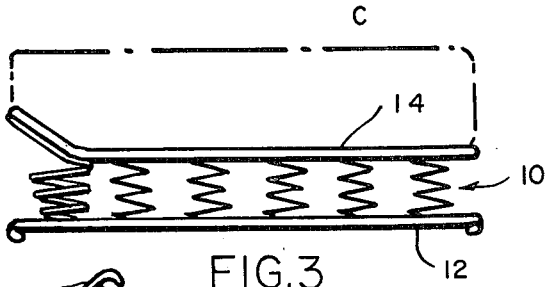
FIG. 3 is a side elevation of the assembly with a cushion shown in phantom resting on the top frame member.
Figure 4:
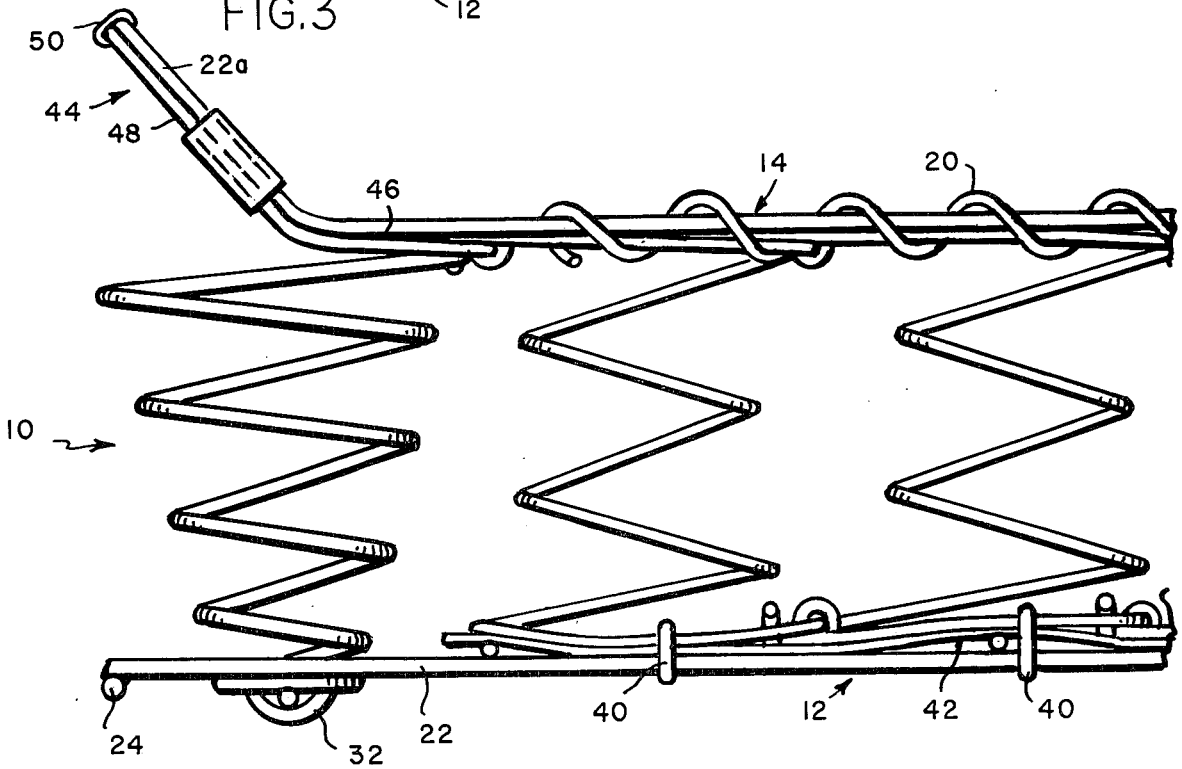
FIG. 4 is a fragmentary side elevation on a much larger scale showing in detail the structure connecting the coils to the top and bottom frame members.

Notably in this kind of structure, there is a tendency, because of the fact that when a person sits down and thus depresses the spring structure, for the cushion represented at C, FIG. 3, to slide forwardly and the longer the furniture is used and the more frequently it is used, the more apt this condition is to become aggravated so that it is necessary to restore the cushion to its proper position after each use, otherwise, it presents a somewhat unsightly appearance.

In the past, it has been the practice to attach a roll of fabric to the forward edge of the upper frame member to provide a barrier and friction member for engagement with the underside of the cushion to prevent it from being displaced forwardly. Attaching the roll to the upper frame member requires added work, adding covering material which should match that of the cushion material and, hence, necessarily increases the cost of the structure.

In substitution of such a pad, the front edge of the spring assembly has been modified in various ways to provide a retaining member as shown, for example, in U.S. Pat. Nos. to Haney 3,479,672 and 3,324,485; Riddle 3,908,974; Garrison 3,529,815; Isaacs 3,117,774 and Bond 3,356,358.

Of the foregoing patents, only Haney is specifically applicable to a spring assembly made up of coil springs and the structure shown in the Haney patents is inherently weak.

The purpose of this invention is to provide a border construction at the front of a spring assembly of coil springs which will effectively provide a long-lasting supporting barrier. As herein illustrated, this is achieved by bending the top loops 44 of each of the coils 10 in the front row of coils upwardly relative to the plane of the upper ends of the coils rearwardly thereof so as to provide a first upwardly inclined portion 46 but at a relatively low *a* which is substantially the helix angle of the coil and which extends from the rear sides of the coils forwardly toward the front sides to approximately the vertical axis of the coils represented by the line X—X which axes when joined form the line of the front row of coils and a second upwardly bent portion 48 which extends from the first portion upwardly and forwardly at a relatively sharp angle *b* greater than said helix angle. The upper frame member 14 at the front edge is correspondingly bent upwardly 22*a*—22*a* from the horizontal plane of the upper ends of the coils substantially at the break between the first and second portions 46 and 48 at an angle corresponding to the angle of inclination of the forward portions 48. Clincher clips 50 are employed to fasten the upper ends of the upwardly bent portions 48 of the coils to the frame member 24 at the front and corresponding clincher clips 52 are employed to attach the upwardly bent second portion 48 of the coils at opposite sides to the inclined portions 22*a*—22*a* the frame member.

As thus constructed, the low angle portions 46 and high angle portions 48 in conjunction provide a gradual transition from the horizontal to the upturned position of the cushion so as to avoid deformation of the top surface of the cushion to the extent of producing a gutter along the top and also to provide a sufficiently stiff support at the extreme forward edge to counter the pressure of a person sitting on the edge which would, in a construction such as shown in the patented structure, be completely depressed because of the long unsupported cantilever construction embodied therein.

It should be understood that the present disclosure is for the purpose of illustration only and includes all modifications or improvements which fall within the scope of the appended claims.

I claim:

1. An upholstery spring comprising a base, a superimposed spaced parallel border wire, a plurality of equal length upright helical coil springs disposed in transverse rows between the base and border wire parallel to the front and back of the assembly, said border wire at the line of centers of the front row of coils at opposite ends of the front row of coils being bent upwardly at angles greater than the angle of inclination of the helical angles of the coils, and the top loops of said coils of the first row of coils having rear and forward portions bent relative to each other such that there are portions rearwardly of the line of centers of the front row of coils bent at substantially the angle of the helix of the coils which form with the loops at the upper ends of the coils rearwardly thereof a substantial part of the cushion-supporting surface and portions forwardly thereof bent upwardly at angles to the rear portions corresponding to the angles of inclination of the bent up portions of the border wire at the opposite ends of the first row, which collectively define an upwardly inclined shoulder rising from the planar surface of the center line of the centers of the front row of coils for constraining forward movement of the cushion relative to said planar surface and means connecting the upper ends of said upwardly bent portions of the loops of the first row of coils to the border wire.

* * * * *